US005165323A

United States Patent [19]

Sato

[11] Patent Number: 5,165,323

[45] Date of Patent: Nov. 24, 1992

[54] PNEUMATIC ACTUATORS FOR MANIPULATORS

[75] Inventor: Teruyoshi Sato, Kawasaki, Japan

[73] Assignee: Bridgestone Corporation, Tokyo, Japan

[21] Appl. No.: 771,101

[22] Filed: Oct. 4, 1991

[30] Foreign Application Priority Data

Oct. 4, 1990 [JP] Japan ..... 2-267340

[51] Int. Cl.[5] ..... F01B 19/04

[52] U.S. Cl. ..... 92/92; 92/165 R

[58] Field of Search ..... 92/92, 60, 165 R

[56] References Cited

U.S. PATENT DOCUMENTS 4,615,260 10/1986 Takagi et al. ..... 92/92

4,860,639 8/1989 Sakaguchi ..... 92/92

5,067,390 11/1991 Negisha ..... 92/92

*Primary Examiner*—Edward K. Look

*Assistant Examiner*—F. Daniel Lopez

*Attorney, Agent, or Firm*—Sughrue, Mion, Zinn, Macpeak & Seas

[57] ABSTRACT

A pneumatic actuator includes an elongate tubular body of a rubber-like elastic material, a braided reinforcing structure arranged on outer circumferential wall of the tubular body and composed of high tensile strength fibers oriented at a predetermined initial braiding angle with reference to longitudinal axis of the tubular body, and two closure members tightly closing the axial ends of the tubular body, respectively. At least one closure member has a connection hole for supplying pressurized fluid into a pressure chamber inside of the tubular body so that axial length of the actuator changes depending upon the initial braided angle of the reinforcing structure. Two hollow cylindrical fitting members are connected to the closure members and relatively slidably fitted with each other inside of the pressure chamber. The fitting members serve to guide axial deformation of the tubular body and define a center chamber which is sealed from the pressure chamber and maintained in communication with atmosphere, for reducing the required volume of the pressuried fluid to be supplied to the pressure chamber in operation.

14 Claims, 1 Drawing Sheet

PNEUMATIC ACTUATORS FOR MANIPULATORS

BACKGROUND OF THE INVENTION

1. Field of the Invention

The present invention relates to a pneumatic actuator for a manipulator, and more particularly to a so-called air-bag type actuator with an elongate tubular body having an inner pressure chamber to be supplied with pressurized working fluid for causing longitudinal deformation of the tubular body.

2. Description of the Related Art

Various kinds of actuators for converting electrical energy or pressurized fluid energy into mechanical energy are known in the art, e.g. electric motors, hydraulic cylinder/piston devices, etc. However, there are many instances where it is undesirable or difficult to put these actuators into practical use.

For example, an ordinary electric motor tends to generate sparks and is sometimes dangerous in explosive environment as is typically the case in powder industry or oil industry. Besides, electric motor generally requires a reduction gear mechanism and cannot be directly connected to appliances to be driven by the motor. It is therefore difficult to improve the operational efficiency and reliability of the total system involving a motor. On the other hand, a hydraulic cylinder/piston device operated by pressurized working oil requires a careful control of the oil in terms of its temperature and purity, and becomes bulky in shape and/or size when a higher power output is required. The cylinder/piston device further encounters difficulties in effectively avoiding environmental contamination by completely preventing undesirable oil leakage.

In order to overcome the aforementioned problems, there has been proposed a pneumatic actuator as disclosed, e.g., in U.S. Pat. No(s). 4,615,260 and 4,860,639, both assigned to the assignee of this application. The pneumatic actuator according to these proposals includes an elongate tubular body of a rubber-like elastic material, with an outer circumferential wall and an inner pressure chamber. A braided reinforcing structure is arranged on the outer circumferential wall of the tubular body, and is composed of cords of high tensile strength fibers oriented at an initial braiding angle relative to the longitudinal axis of the tubular body, which is determined with reference to a so-called "angle of repose" of the braided structure. The axial ends of the tubular body are tightly closed by closure members, at least one of which has a connection hole for supplying pressurized fluid into the pressure chamber in the tubular body to cause an axial contraction or elongation of the actuator depending upon the initial braided angle of the reinforcing structure.

The pneumatic actuator of such a structure proved to be quite advantageous in that it is light in weight, smooth in operation, easy to control and free from environmental contamination, as compared with conventional actuators in the form of electric motors, hydraulic cylinder/piston devices, etc. Still, however, it is highly desirable to further enhance the versatile utility of the pneumatic actuator in terms of a reduced consumption of energy required for operating the actuator and more improved reliability in operation, while maintaining all the advantages mentioned above.

DISCLOSURE OF THE INVENTION

It is an object of the present invention to provide an improved pneumatic actuator which can be operated with a reduced consumption of energy and with a higher operational reliability.

Briefly stated, according to the present invention, there is provided a pneumatic actuator which includes an elongate tubular body of a rubber-like elastic material, a braided reinforcing structure arranged on outer circumferential wall of the tubular body and composed of cords of high tensile strength fibers oriented at a predetermined initial braiding angle with reference to longitudinal axis of the tubular body, and two closure members tightly closing the axial ends of the tubular body, respectively. At least one closure member has a connection hole for supplying pressurized fluid into a pressure chamber inside of the tubular body so that axial length of the actuator changes depending upon the initial braided angle of the reinforcing structure.

According to the present invention, furthermore, two hollow cylindrical fitting members are connected to the closure members and relatively slidably fitted with each other inside of the pressure chamber. The fitting members serve to guide the movement of the axial ends of the tubular body relative to each other, as the pressurized fluid is supplied into or exhausted from the pressure chamber of the tubular body, and define a center chamber which is sealed from the pressure chamber and maintained in communication with atmosphere, for reducing the required volume of the pressurized fluid to be supplied to the pressure chamber in operation.

The elongate tubular body of the actuator according to the present invention is composed of a rubber-like material or so-called elastomer so that the tubular body can be readily inflated by supplying pressurized fluid into the pressure chamber inside of the tubular body.

The reinforcing structure surrounding the outer circumferential wall of the tubular body is composed of braided cords oriented at a predetermined initial braiding angle relative to the longitudinal axis of the tubular body. The cords may be composed of organic or inorganic fibers having a high tensile strength, e.g. nylon fibers, polyester fibers, aromatic polyamide fibers, carbon fibers, or composed of twisted or non-twisted filament bundles of ultrafine metal wires, e.g. steel filaments.

The actuator according to the present invention functions in two different ways, depending upon the braiding angle of the reinforcing structure with reference to an angle of repose of the reinforcing structure (typically 54°44'). Thus, when the braiding angle is smaller than the angle of repose of the reinforcing structure, preferably 15° to 20°, the actuator undergoes an axial contraction as pressurized fluid is supplied into the pressure chamber inside of the tubular body. On the contrary, when the braiding angle is greater than the angle of repose of the reinforcing structure, preferably 70° to 80°, the actuator undergoes an axial elongation as pressurized fluid is supplied into the pressure chamber of the tubular body. Consequently, the actuator according to the invention can be selectively operated as an elongating body or a contracting body depending upon the braiding angle of the reinforcing structure, in view of various operative conditions or requirements imposed on the actuator.

The present invention features the provision of two hollow cylindrical fitting members which are connected to the closure members to extend inside of the pressure chamber. These fitting members are relatively slidably fitted with each other for properly guiding the movement of the axial ends of the tubular body relative to each other, as the pressurized fluid is supplied into or exhausted from the pressure chamber of the tubular body, thereby to improve the operational reliability of the actuator by effectively avoiding undesirable buckling of the actuator during its elongation mode. Furthermore, the fitting members defining the center chamber, which is sealed from the pressure chamber and maintained in communication with atmosphere, serve to reduce the required volume of the pressurized fluid to be supplied to the pressure chamber in operation thereby to minimize the consumption of energy required for operating the actuator.

Advantageously, the actuator according to the present invention further comprises resilient seal means arranged in a gap between the fitting members for permitting a relative axial sliding motion of the fitting members while inhibiting leakage of the pressurized fluid in the pressure chamber of the tubular body through the gap into the center chamber defined by the fitting members. The seal means may be composed of at least one seal element in the form of O-ring, or may be a cylindrical seal element of resilient material, with a pair of axial ends which are fixedly secured to the fitting members, respectively.

BRIEF DESCRIPTION OF THE DRAWINGS

The present invention will be explained in further detail hereinafter, with reference to some specific embodiments illustrated in the accompanying drawings, in which.

DETAILED DESCRIPTION OF THE PREFERRED EMBODIMENT

Figure 1:
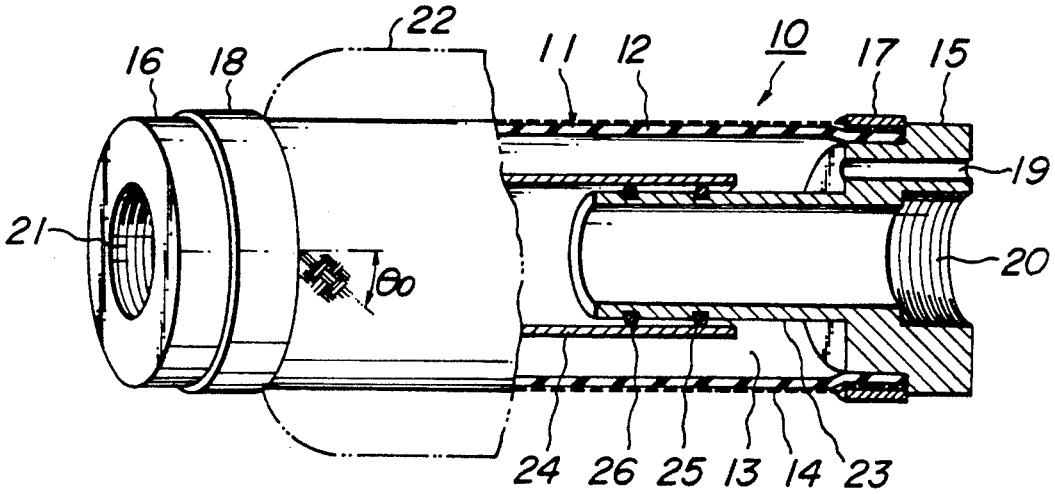
FIG. 1 is a perspective view, partly in section, of a pneumatic actuator according to one embodiment of the invention.

Referring now to FIG. 1, there is shown a pneumatic actuator according to a first embodiment of the present invention. The actuator is designated as a whole by reference numeral 10, and includes a tubular body 11 composed of a rubber-like elastic material with an excellent flexibility. The tubular body 11 has an outer circumferential wall 12 and an inner pressure chamber 13 defined by the wall 12.

A braided reinforcing structure 14 is arranged on the wall 12 of the tubular body, and is composed of cords of appropriate high tensile strength fibers, e.g. polyester fibers. The cords of the reinforcing structure 14 are oriented at an initial braiding angle $\theta_O$ relative to the longitudinal axis of the tubular body 11. The initial braiding angle in this embodiment is smaller than the angle of repose of the reinforcing structure 14, and is approximately within a range of 15° to 20°.

The axial ends of the tubular body 11 are tightly closed by two closure members 15, 16, respectively. The closure members 15, 16 may be each composed of appropriate metal material, e.g. aluminum alloy, stainless steel, ordinary steel, etc. More preferably, however, the closure members 15, 16 are composed of an appropriate synthetic resin material for lightening purpose, including a so-called engineering plastic material. The closure members 15, 16 are preferably press-fitted onto the axial ends of the tubular body 11, e.g. by clamp rings 17, 18.

At least one of the closure members, i.e. the member 15 in the illustrated example, is formed with a connection hole 19 which is to be connected to a pressurized fluid source (not shown) in operation so that pressurized fluid from the source can be supplied into and exhausted from the pressure chamber 13 in the tubular body 11 through the connection hole 19. The closure members 15, 16 may be formed with inside screw threads 20, 21 in their respective central portion, for mechanically connecting a plurality of actuators 10 in series, or for connecting the actuator 10 with other appliances to be driven by the actuator or with an appropriate connectors for such purposes.

In the embodiment shown in FIG. 1, as the pressure chamber 13 inside of the tubular body 11 is supplied with a pressurized fluid, the tubular body 11 is inflated and undergoes a radial expansion as schematically shown at 22, thereby increasing its diameter until the braided angle reaches the angle of repose. On this occasion, the tubular body 11 undergoes an axial contraction thereby decreasing the distance between the axial ends of the tubular body or between the closure members 15, 16, since the radial expansion of the tubular body 11 is limited by the reinforcing structure 14 and the initial braiding angle $\theta_O$ of the reinforcing structure 14 is smaller than its angle of repose as mentioned hereinabove. That is, due to the initial braiding angle $\theta_O$ which is smaller than the angle of repose of the reinforcing structure 14, the actuator 10 of this embodiment functions as one which contracts axially when supplied with a pressurized fluid.

The above-mentioned basic structure and function of the actuator according to the present invention are substantially same as those disclosed in the aforementioned U.S. Pat. No(s). 4,615,260 and 4,860,639, so that the entire disclosures of these patents are herein incorporated by reference.

In the present invention, the closure members 15, 16 at the axial ends of the tubular body 11 are provided with substantially cylindrical hollow fitting members 23, 24, respectively. These fitting members 23, 24 project in the axial direction toward each other within the pressure chamber 13 of the tubular body 11, and are fitted with each other so as to allow a relative telescopic sliding motion therebetween. Resilient seal elements in the form of O-rings 25, 26 are disposed in a gap between the fitting members 23, 24 so that a hollow center chamber is formed within the fitting members, which is sealed from the pressure chamber 13 and maintained in communication with atmosphere through appropriate passages (not shown).

The fitting members 23, 24 serve to properly guide the relative movement of the axial ends of the tubular body 11 to improve the operational reliability of the actuator by effectively avoiding undesirable buckling of the actuator during its elongating mode when the pressurized fluid is exhausted from the pressure chamber 13 of the tubular body 11. Furthermore, by defining the center chamber within the fitting members 23, 24, which is sealed from the pressure chamber 13 and maintained in communication with atmosphere, serve to reduce the required volume of the pressurized fluid to be supplied to the pressure chamber 13 in operation and minimize the consumption of energy required for operating the actuator 10.

Figure 2:
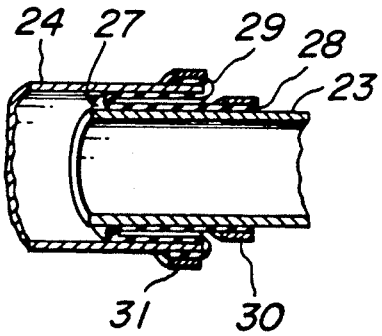
FIG. 2 is a schematic sectional view showing a modification of the seal element in the embodiment of FIG. 1.

There is shown in FIG. 2 a modified example of the resilient seal element 27 which is disposed between the fitting members 23, 24 to seal the center chamber from the pressure chamber 13 while allowing a relative axial movement of the fitting members 23, 24. The seal element 27 is in the form of a cylindrical member of a resilient material, with a pair of axial ends 28, 29 which are fixedly secured to the fitting members 23, 24, respectively, by means of clamp rings 30, 31.

Furthermore, although not shown in the drawings, the seal element between the fitting members 23, 24 may be of a bellows structure with a corrugated longitudinal section, which is arranged on outer sides of the fitting members 23, 24 with its both axial ends tightly clamped at the regions of the fitting members 23, 24 adjacent to the closure members 15, 16, or may be a so-called labyrinth structure.

Figure 3:
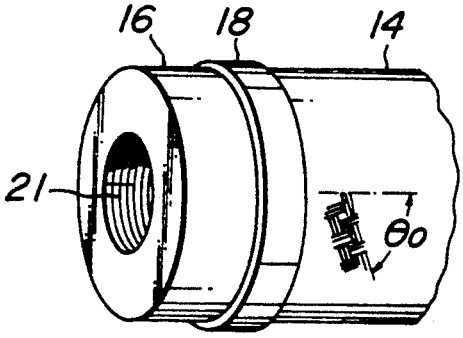
FIG. 3 is a fragmentary perspective view of a pneumatic actuator according to another embodiment of the invention.

There is shown in FIG. 3 a second embodiment of the invention, which differs from the previous embodiment solely in that the reinforcing structure 14 formed of braided cords of polyester fibers has an initial braiding angle $\theta_O$ which is greater than the angle of repose of the reinforcing structure 14. Preferably, the initial braiding angle is approximately within a range of 70° to 80°.

As in the previous embodiment, when the pressure chamber 13 inside of the tubular body 11 is supplied with a pressurized fluid, the tubular body 11 is inflated and undergoes a radial expansion thereby increasing its diameter until the braided angle reaches the angle of repose. On this occasion, the tubular body 11 undergoes an axial elongation thereby increasing the distance between the axial ends of the tubular body or between the closure members 15, 16, since the radial expansion of the tubular body 11 is limited by the reinforcing structure 14 and the initial braiding angle $\theta_O$ of the reinforcing structure 14 is greater than its angle of repose as mentioned hereinabove.

That is, due to the initial braiding angle $\theta_O$ which is greater than the angle of repose of the reinforcing structure 14, the actuator 10 of this embodiment functions as one which elongates axially when supplied with a pressurized fluid.

The actuator according to the embodiment of FIG. 3 also includes the fitting members which are essentially same as the fitting members 23, 24 shown in FIGS. 1 and 2. These fitting members serve to properly guide the relative movement of the axial ends of the tubular body 11 to improve the operational reliability of the actuator by effectively avoiding undesirable buckling of the actuator during its elongating mode when the pressurized fluid is supplied into the pressure chamber 13 of the tubular body 11. Furthermore, by defining the center chamber within the fitting members, which is sealed from the pressure chamber 13 and maintained in communication with atmosphere, it is possible to reduce the required volume of the pressurized fluid to be supplied to the pressure chamber 13 in operation and minimize the consumption of energy required for operating the actuator 10.

It will be appreciated from the foregoing description, that the pneumatic actuator according to the present invention is capable of efficiently converting the energy of a pressurized fluid into mechanical energy, making it possible to realize an actuator which is small in size and light in weight as compared with known actuators in the form of electric motors or hydraulic cylinder/piston device. Due to the absence of electric power supply line, the actuator according to the invention can be used for various purposes, even in an explosive environment. Furthermore, the hollow cylindrical fitting members connected to the closure members and relatively slidably fitted with each other inside of the pressure chamber serve to guide the movement of the axial ends of the tubular body relative to each other, as the pressurized fluid is supplied into or exhausted from the pressure chamber of the tubular body, and define a center chamber which is sealed from the pressure chamber and maintained in communication with atmosphere, for reducing the required volume of the pressurized fluid to be supplied to the pressure chamber in operation.

The present invention thus provides an improved pneumatic actuator which can be operated with a reduced consumption of energy and with a higher operational reliability.

What is claimed is:

1. A pneumatic actuator comprising:

an elongate tubular body composed of a rubber-like elastic material and having an outer circumferential wall with a pair of axial ends, and a pressure chamber defined inside of the outer circumferential wall;

a braided reinforcing structure arranged on the outer circumferential wall of the tubular body and composed of organic or inorganic high tensile strength fibers which are oriented at a predetermined initial braiding angle with reference to longitudinal axis of said tubular body;

two closure members tightly closing the axial ends of said tubular body, respectively, at least one of the closure members having a connection hole for supplying a pressurized fluid into the pressure chamber of the tubular body; and two substantially hollow cylindrical fitting members respectively connected to said closure members inside of said pressure chamber and extending axially toward each other, said fitting members being relatively slidably fitted with each other to define a center chamber which is sealed from said pressure chamber and maintained in communication with atmosphere.

2. The pneumatic actuator as set forth in claim 1, wherein said initial braiding angle of the reinforcing structure is smaller than angle of repose of the reinforcing structure.

3. The pneumatic actuator as set forth in claim 2, wherein said initial braiding angle of the reinforcing structure is approximately within a range of 15° to 20°.

4. The pneumatic actuator as set forth in claim 1, wherein said initial braiding angle of the reinforcing structure is larger than angle of repose of the reinforcing structure.

5. The pneumatic actuator as set forth in claim 4, wherein said initial braiding angle of the reinforcing structure is approximately within a range of 70° to 80°.

6. The pneumatic actuator as set forth in claim 1, further comprising resilient seal means arranged in a gap between said fitting members for permitting a relative axial sliding motion of the fitting members while inhibiting leakage of the pressurized fluid in said pressure chamber of the tubular body through said gap into said center chamber defined by the fitting members.

7. The pneumatic actuator as set forth in claim 6, wherein said seal element comprises an O-ring.

8. The pneumatic actuator as set forth in claim 6, wherein said seal element comprises a cylindrical element of a resilient material, with a pair of axial ends which are fixedly secured to said fitting members, respectively.

9. A pneumatic actuator comprising:

an elongate tubular body composed of a rubber-like elastic material and having an outer circumferential wall with a pair of axial ends, and a pressure chamber defined inside of the outer circumferential wall;

a braided reinforcing structure arranged on the outer circumferential wall of the tubular body and composed of organic or inorganic high tensile strength fibers which are oriented at a predetermined initial braiding angle with reference to longitudinal axis of said tubular body, which is smaller than angle of repose of the reinforcing structure;

two closure members tightly closing the axial ends of said tubular body, respectively, at least one of the closure members having a connection hole for supplying a pressurized fluid into the pressure chamber of the tubular body; and guide means for guiding axial movement of said axial ends of the tubular body relative to each other as the pressurized fluid is supplied into or exhausted from the pressure chamber of the tubular body, said guide means comprising two substantially hollow cylindrical fitting members respectively connected to said closure members inside of said pressure chamber and extending axially toward each other, said fitting members being relatively slidably fitted with each other to define a center chamber which is sealed from said pressure chamber and maintained in communication with atmosphere.

10. The pneumatic actuator as set forth in claim 9, wherein said initial braiding angle of the reinforcing structure is approximately within a range of 15° to 20°.

11. The pneumatic actuator as set forth in claim 9, further comprising resilient seal means arranged in a gap between said fitting members for permitting a relative axial sliding motion of the fitting members while inhibiting leakage of the pressurized fluid in said pressure chamber of the tubular body through said gap into said center chamber defined by the fitting members.

12. A pneumatic actuator comprising:

an elongate tubular body composed of a rubber-like elastic material and having an outer circumferential wall with a pair of axial ends, and a pressure chamber defined inside of the outer circumferential wall;

a braided reinforcing structure arranged on the outer circumferential wall of the tubular body and composed of organic or inorganic high tensile strength fibers which are oriented at a predetermined initial braiding angle with reference to longitudinal axis of said tubular body, which is greater than angle of repose of the reinforcing structure;

two closure members tightly closing the axial ends of said tubular body, respectively, at lest one of the closure members having a connection hole for supplying a pressurized fluid into the pressure chamber of the tubular body; and guide means for guiding axial movement of said axial ends of the tubular body relative to each other as the pressurized fluid is supplied into or exhausted from the pressure chamber of the tubular body, said guide means comprising two substantially hollow cylindrical fitting members respectively connected to said closure members inside of said pressure chamber and extending axially toward each other, said fitting members being relatively slidably fitted with each other to define a center chamber which is sealed from said pressure chamber and maintained in communication with atmosphere.

13. The pneumatic actuator as set forth in claim 12, wherein said initial braiding angle of the reinforcing structure is approximately within a range of 70° to 80°.

14. The pneumatic actuator as set forth in claim 12, further comprising resilient seal means arranged in a gap between said fitting members for permitting a relative axial sliding motion of the fitting members while inhibiting leakage of the pressurized fluid in said pressure chamber of the tubular body through said gap into said center chamber defined by the fitting members.

* * * * *